United States Patent [19]

Olson et al.

[11] Patent Number: 4,919,250

[45] Date of Patent: Apr. 24, 1990

[54] NEWSPAPER OR OTHER ARTICLE VENDING DEVICE

[75] Inventors: John B. Olson, Waukesha; Richard L. Jeanson, Watertown; John D. Sinchok, Oconomowoc, all of Wis.

[73] Assignee: Fortec, Inc., Waukeshi, Wis.

[21] Appl. No.: 212,716

[22] Filed: Jun. 28, 1988

[51] Int. Cl.[5] ..... G07F 11/04

[52] U.S. Cl. ..... 194/248; 49/386; 194/350; 221/155; 221/282; D20/6

[58] Field of Search ..... 194/233, 248, 350; 221/103, 155, 282, 283; 312/101, 102, 138 A; 49/386; D20/6, 9

[56] References Cited

U.S. PATENT DOCUMENTS

| | | | |
|---|---|---|---|
| 3,253,690 | 5/1966 | Brewton et al. | 194/233 |
| 3,321,115 | 5/1967 | Rendahl | 222/473 X |
| 4,158,271 | 6/1979 | Barry | 49/386 |
| 4,399,903 | 8/1983 | McDonald | 194/350 |
| 4,544,081 | 10/1985 | Voegeli | 221/155 |
| 4,582,190 | 4/1986 | Voegeli | 194/248 |
| 4,623,073 | 11/1986 | Hansen | 221/283 X |

*Primary Examiner*—F. J. Bartuska

*Attorney, Agent, or Firm*—Marshall, O'Toole, Gerstein, Murray & Bicknell

[57] ABSTRACT

A vending device for newspapers or other articles comprising a box like receptacle which can be pole or pedestal mounted. The device includes a one piece paper display member, an access door biasing means which is hidden from exposure to the weather, a door latch device which maintains the access door in an open position, a releasable lock device for locking a coin operating mechanism and coin box in the vending device and an access door locking unit for locking the access door to the coin operating mechanism.

36 Claims, 11 Drawing Sheets

16'
97
95
74
70
80
77
73
76
71
64
92
90
96
91
93
94
B
A
82
81
16
II

NEWSPAPER OR OTHER ARTICLE VENDING DEVICE

BACKGROUND OF THE INVENTION

1. FIELD OF INVENTION

This invention relates to a dispensing or vending apparatus for newspapers or other articles and more particularly to a newspaper vending device which can be pole or pedestal mounted and includes improved means for providing a relative ease of access to the vended articles while providing means for precluding the unauthorized removal of a cash box from the vending device.

2. DESCRIPTION OF THE PRIOR ART

Throughout the years there have been a number of different devices available for dispensing articles such as newspapers. The basic operation associated with procuring a newspaper from these devices generally requires that one insert a coin into a coin receptacle opening whereby the device mechanically unlocks to permit access to the vended article. The purchaser then opens a hinged, biased door and removes the vended article. Thereafter, the door closes and automatically locks the device in its normally locked position. Unfortunately, a number of vending devices available are unsatisfactory for a number of reasons. Some units utilize a hinged access door which is inconveniently located between a purchaser and the newspaper storage compartment such that purchasers must bend or otherwise reach over the door to gain access to a paper.

Additionally, access door hinges and springs utilized in some devices presently available are directly exposed to the atmosphere such that over a period of time the hinges and springs become corroded or are otherwise adversely affected.

A further disadvantage encountered with certain newspaper dispensing machines presently available is that means are unavailable to maintain the biased door in an open position particularly when a vendor is inserting or removing papers from the apparatus. A vendor is required to hold the door open manually, the result being that the vendor is not free to use both hands to load or unload papers in the paper storage compartment of the vending machine.

In other instances, it has been found that it is difficult to mount paper vending machines in certain locations because the device has no adequate provisions for mounting the device on a pole or pedestal. Further, some conventional prior art newspaper dispensing machines fail to provide an adequate means for removing the coin operating mechanism and cash box from the unit.

Finally, newspaper dispensing machines presently available generally have a paper display device located adjacent a glass or transparent plastic member located in the access door. It is sometimes found that the paper display means are relatively expensive, bulky and, on occasion, constructed in such a manner that a paper to be displayed is torn in the course of mounting the paper in the display means.

It is desired to eliminate the problems associated with newspaper vending apparatus presently available with a vending device for newspapers or other articles which can be readily and removably mounted on a pedestal, pole or other support fixture.

It is also desired to have a newspaper vending apparatus in which a paper can be prominently displayed and the biased access door is positioned away from the paper storage compartment to permit an individual to have easy access to the paper storage compartment. Moreover, it is desired that the biasing means be hidden from view irrespective of whether the door is in an open or closed position such that the biasing means is protected from the atmosphere. Further, it is desired to provide a device in which the biased access door can be locked in an open position to allow a vendor to use both hands for locking or unlocking operations.

Finally, it is desired to provide a means for permitting the entire coin-locking mechanism to be removed from the newspaper vending apparatus whereby either a cash box or a coin operating unit can be inserted, removed or replaced.

SUMMARY OF THE INVENTION

The apparatus for vending newspapers or other articles disclosed and claimed herein serves to obviate the problems and disadvantages associated with prior art newspaper vending machines. Briefly, the newspaper vending device of the present invention provides a vending unit molded from a moisture resistant plastic material. The vending unit is adapted to be readily and easily mounted on a compatible pedestal or, if desired, the dispensing unit can be mounted on a vertical pole or the like.

The device includes a receptacle having an access door which opens to the side of the apparatus to permit easy access to the paper storage compartment. Moreover, the door biasing means are free from direct exposure to the atmosphere irrespective of whether the door is in an opened or closed position. A releasable door latch means permits the access door to be maintained or locked in an open position so that a vendor can use both hands to load newspapers in the paper storage compartment.

Further, a locking device is provided whereby the coin operating mechanism and cash box can be removed as a unit from the vending machine and either a new cash box, coin operating unit or complete coin operating mechanism can be inserted, replaced or removed.

Additionally, an access door locking means is provided to lock the access door to the coin operating mechanism, the locking device being opened by a key means or by coins inserted in the coin operating mechanism. Further, an integral, one piece paper display member is provided in the access door which permits a paper or other article to be relatively easily inserted in the display member without concern of the paper being torn.

Other objects and advantages of the invention will be apparent from the following detailed description and accompanying drawings.

DESCRIPTION OF THE DRAWINGS p FIG. 1 shows a perspective view of the newspaper vending apparatus of the present invention with the paper vending device being mounted on a compatible pedestal;

Figure 5:
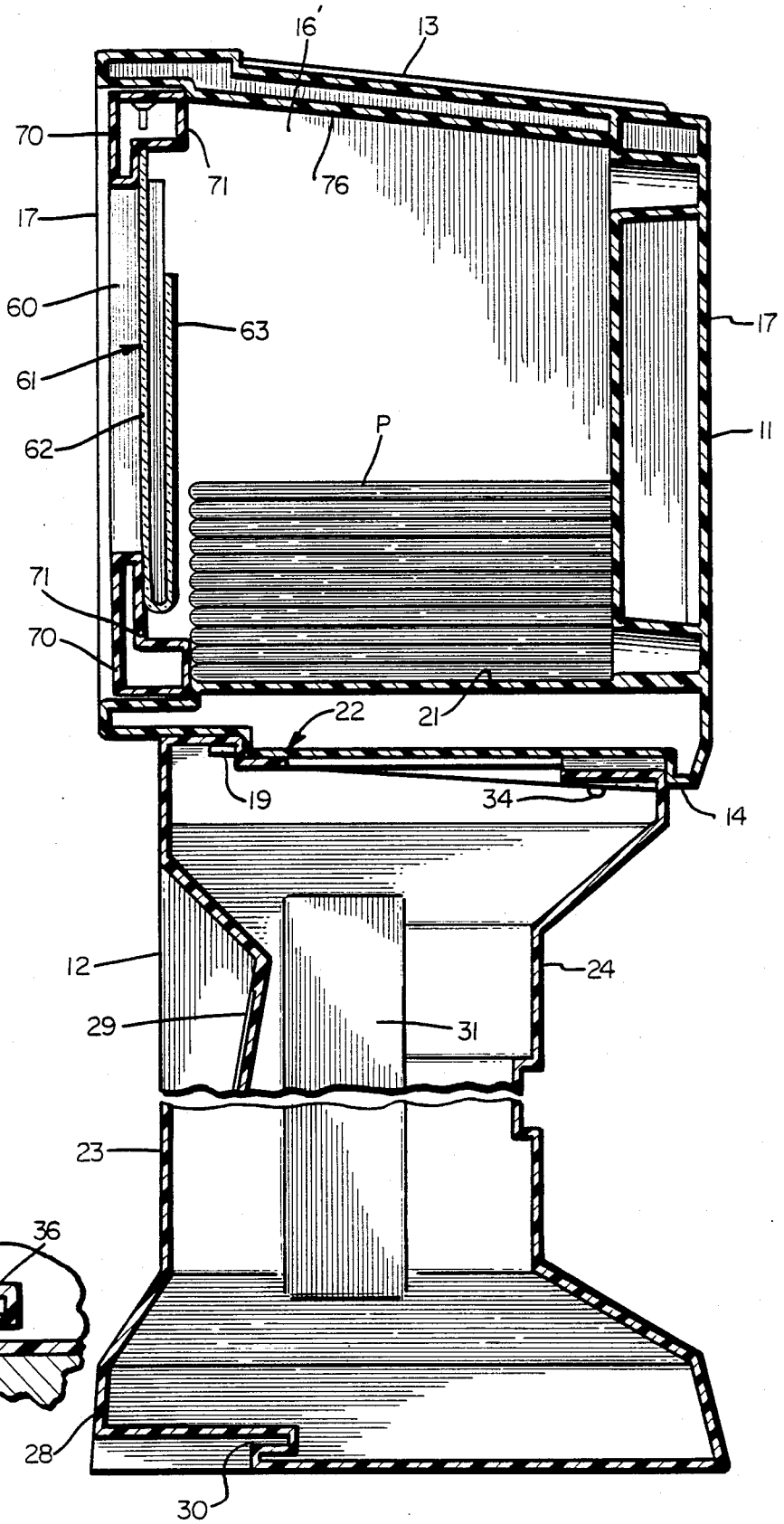
FIG. 5 shows a side, elevation, section view taken along lines 5—5 in FIG. 1 showing papers P disposed in the paper compartment of the vending device.
Figure 5A:
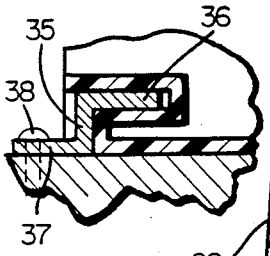
Figure 6:
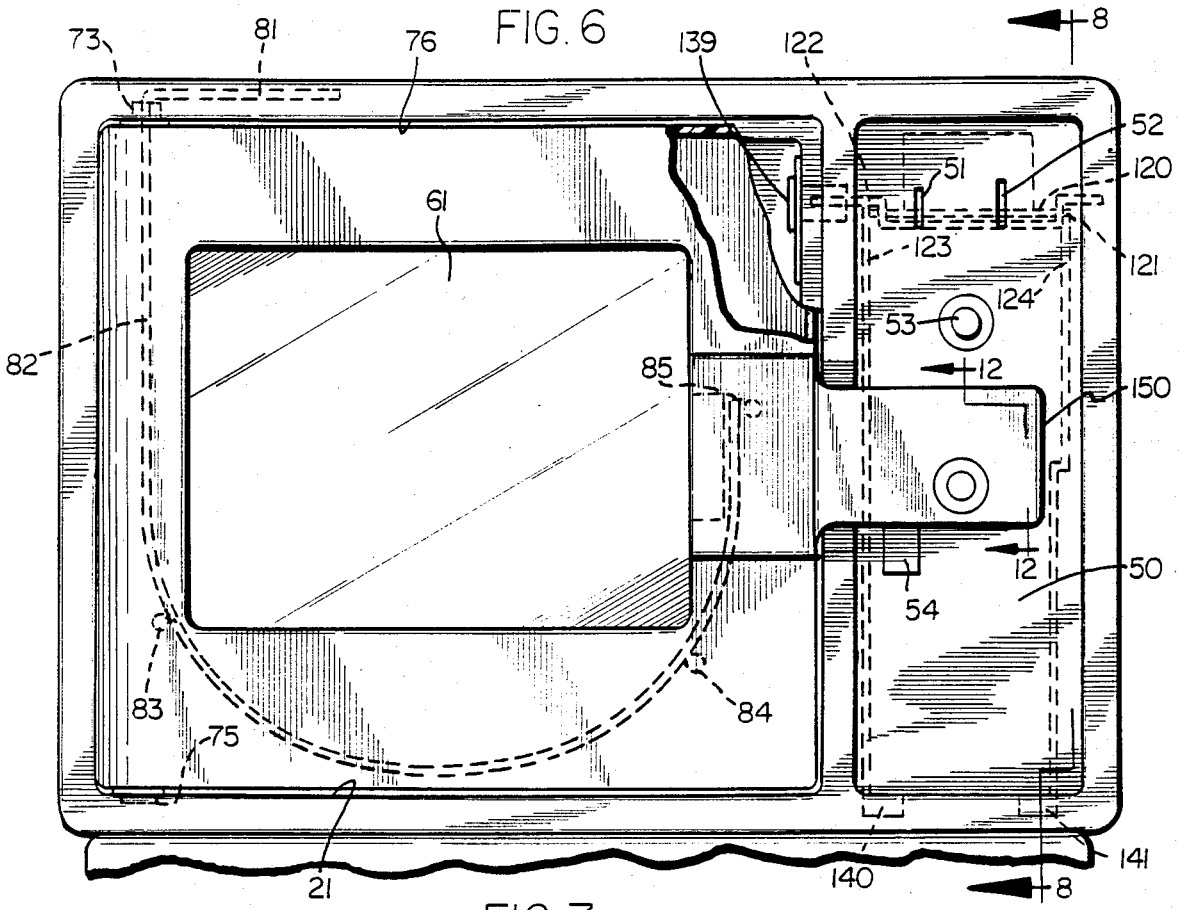
Figure 7:
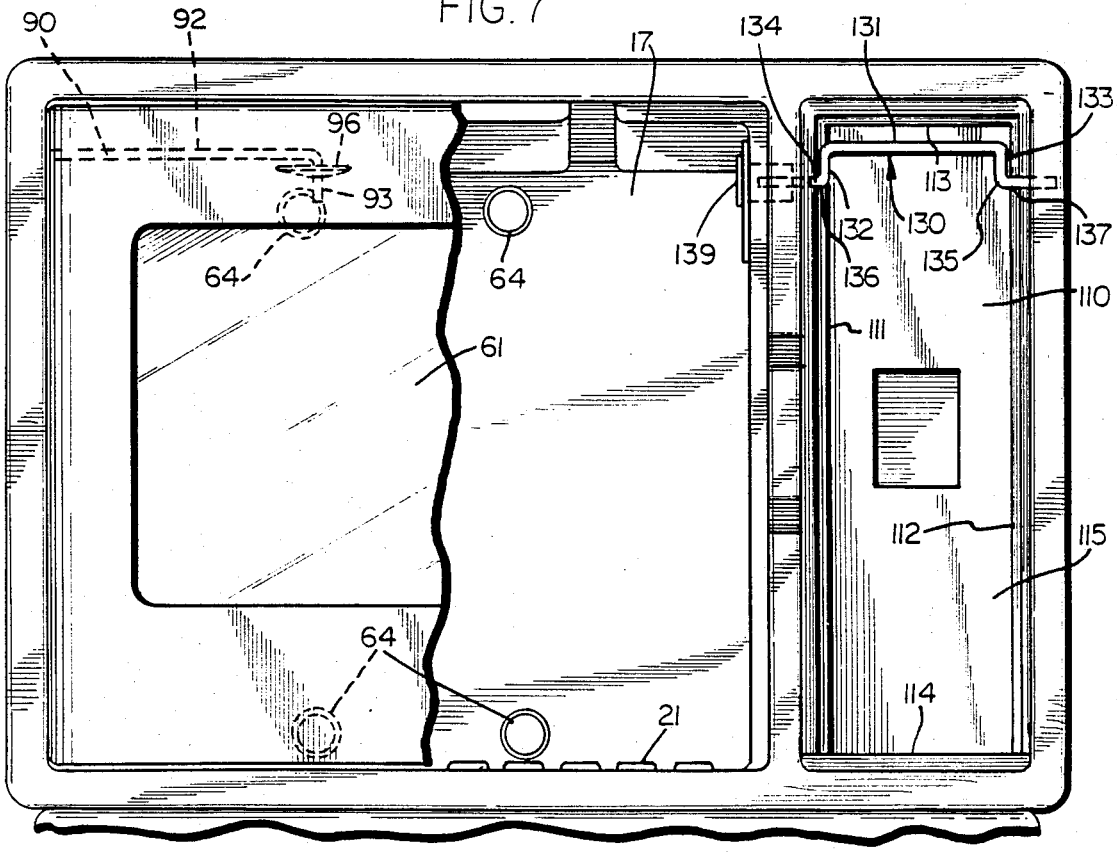
Figure 8:
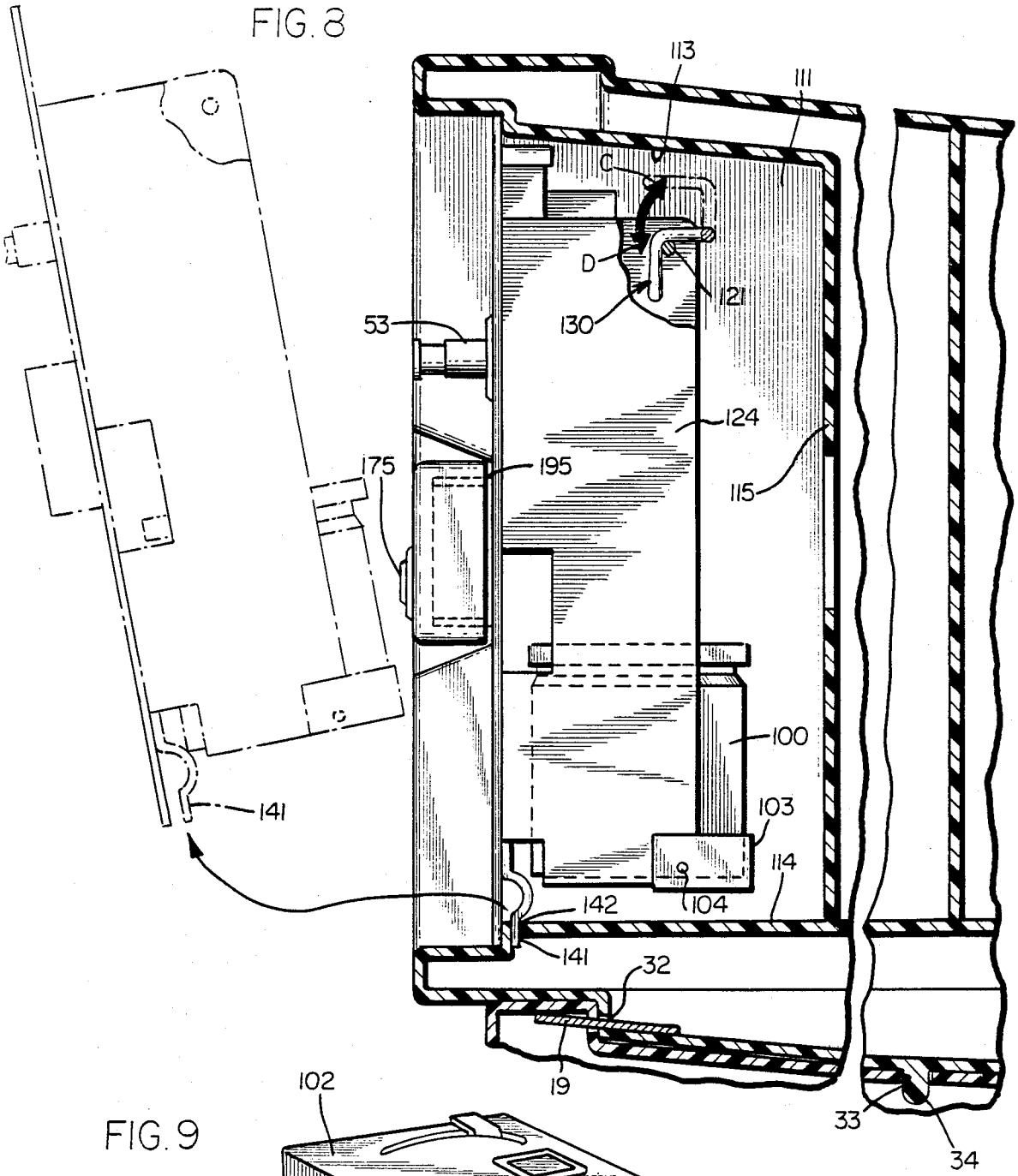
Figure 9:
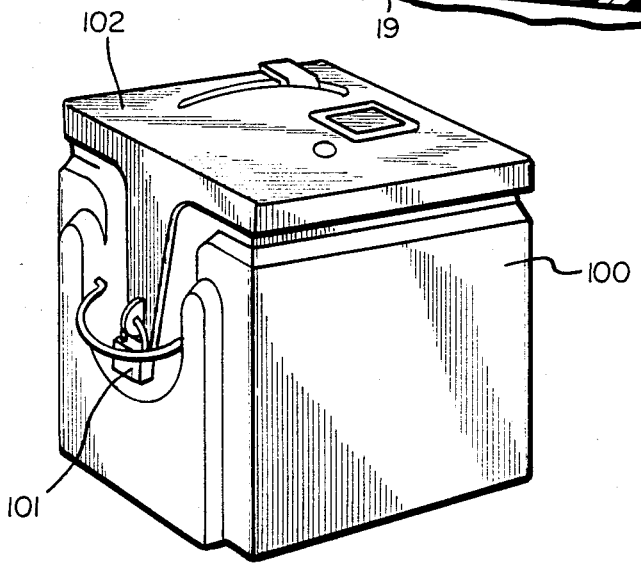
Figures 10, 11:
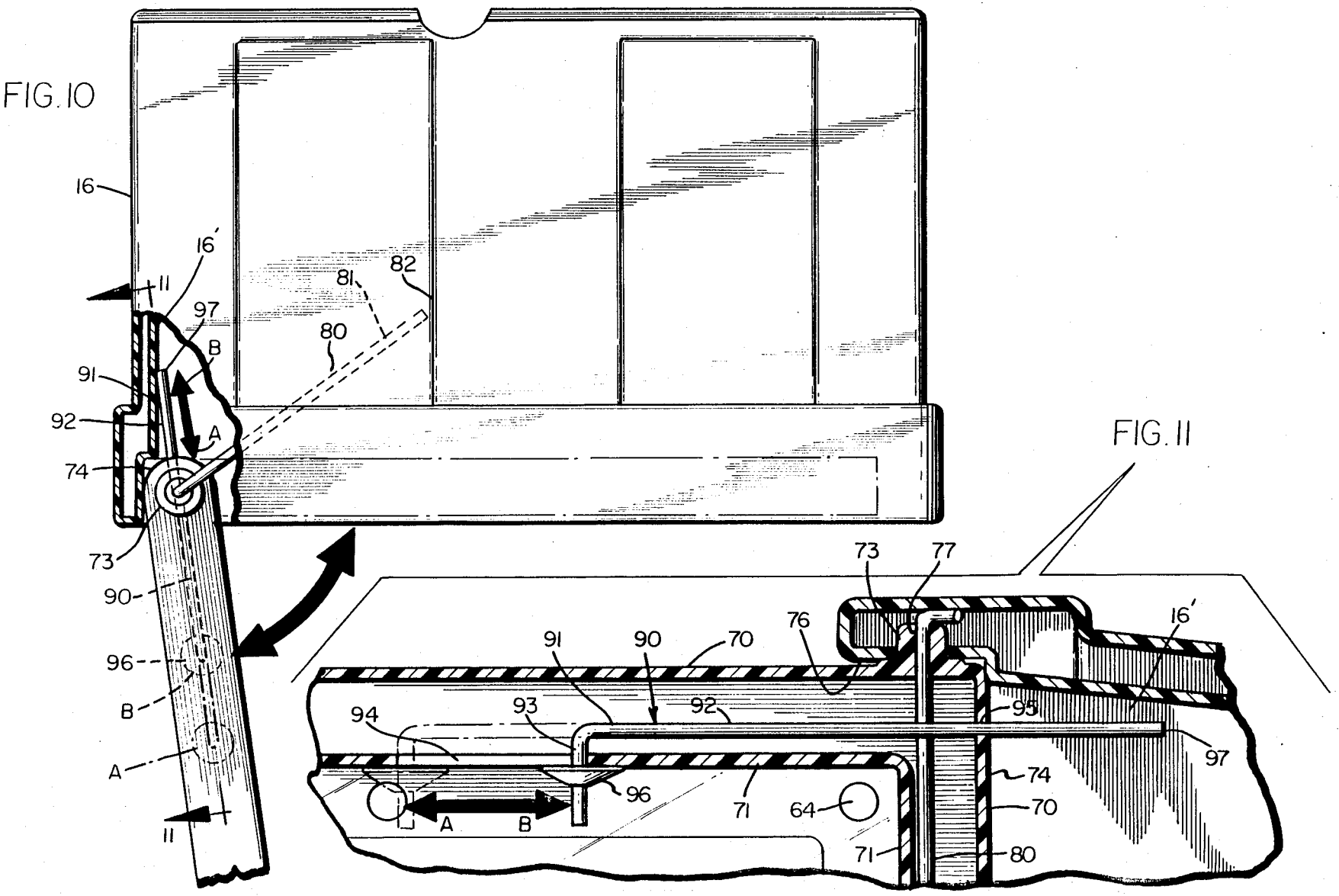
Figure 12:
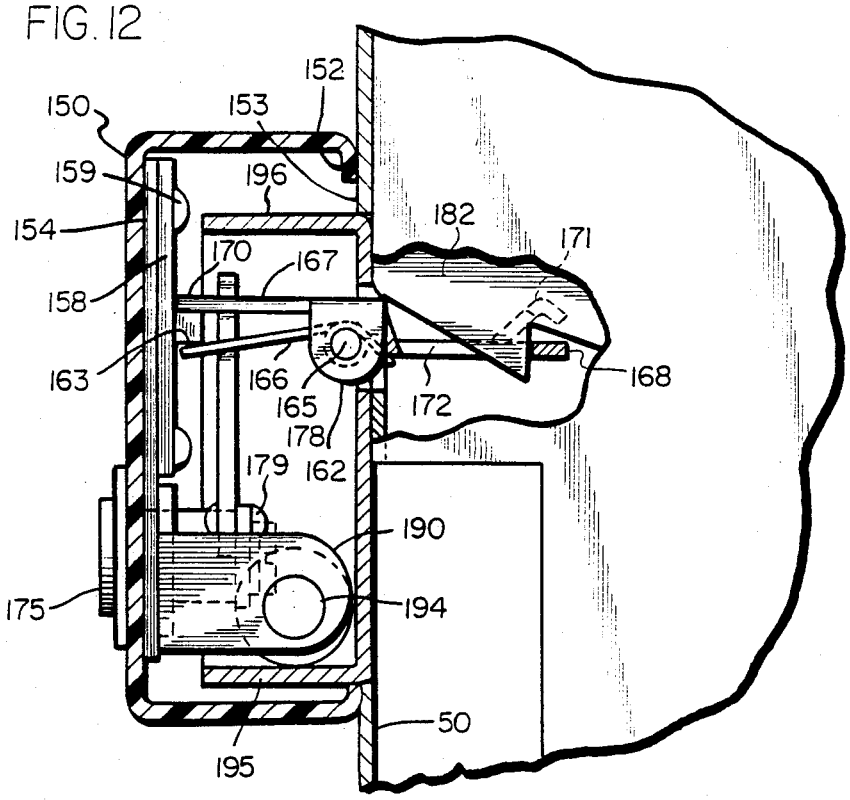
Figure 13:
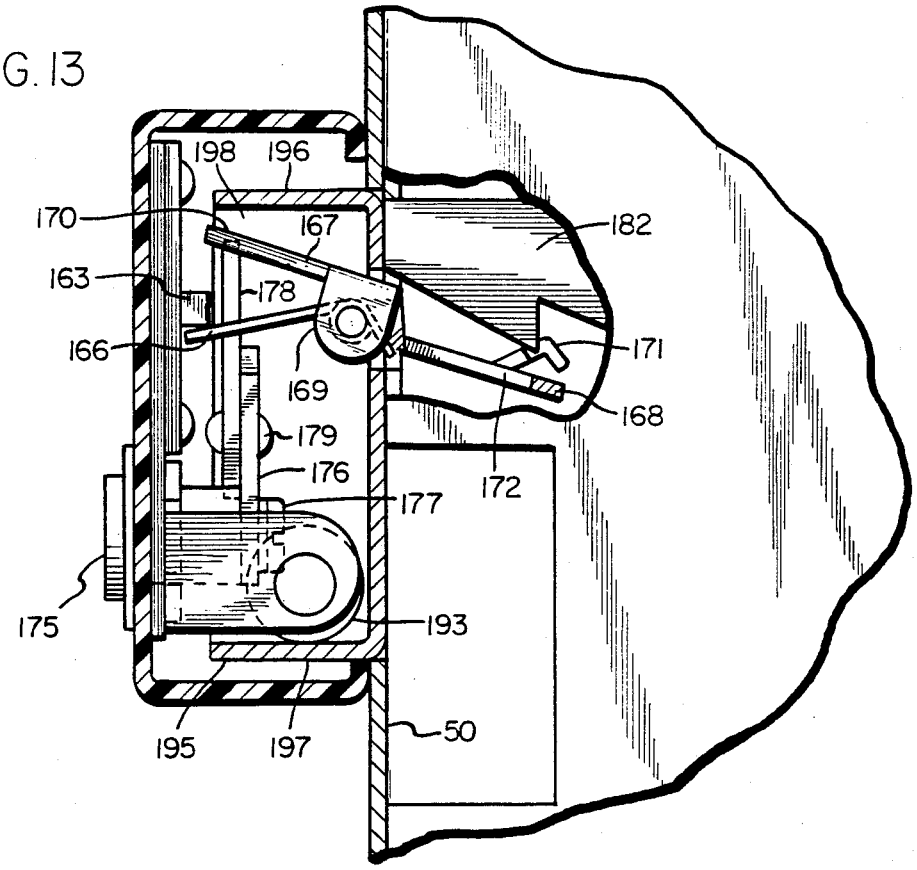
Figure 14:
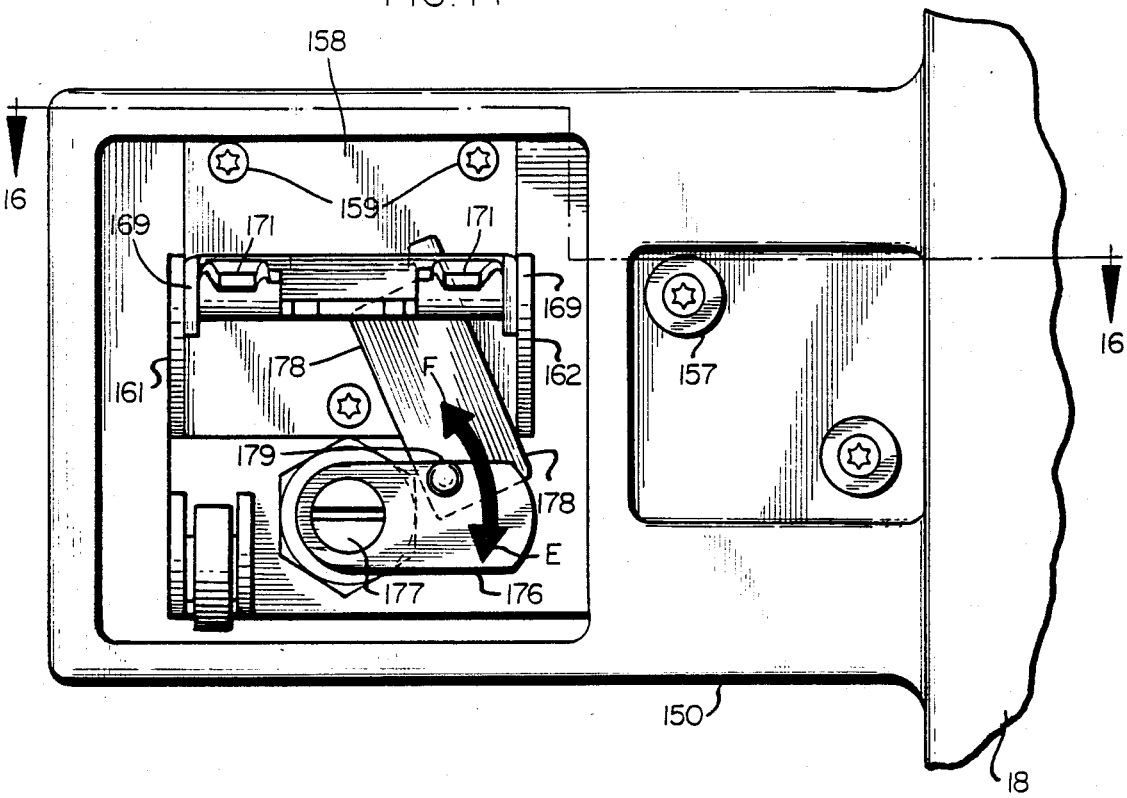
Figure 15:
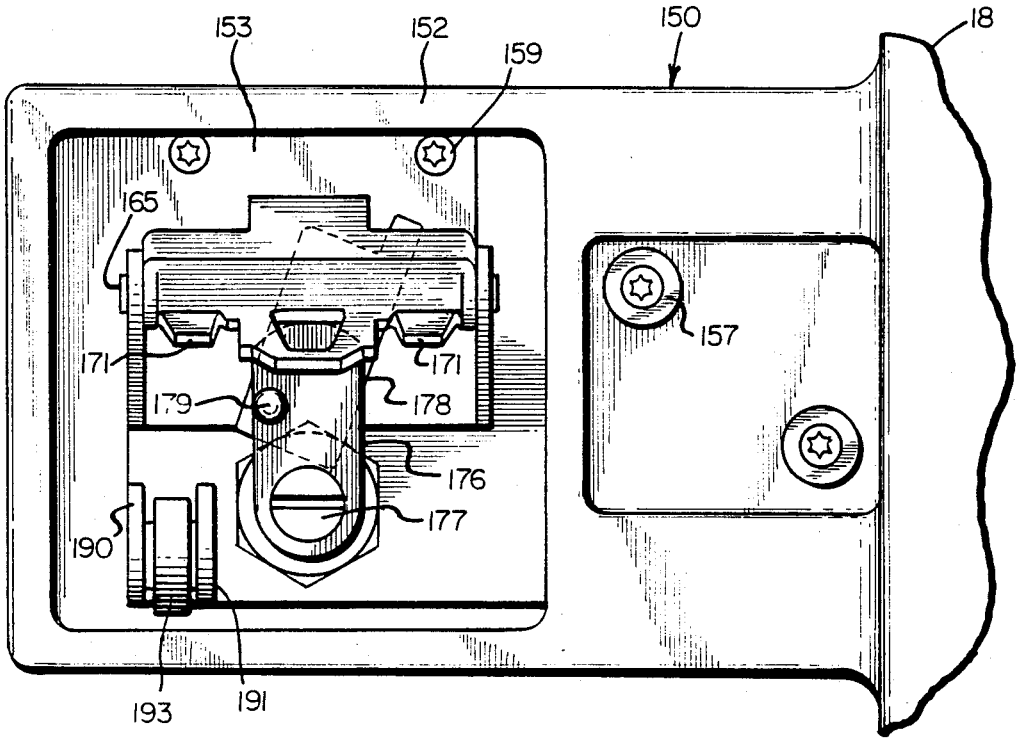
Figure 16:
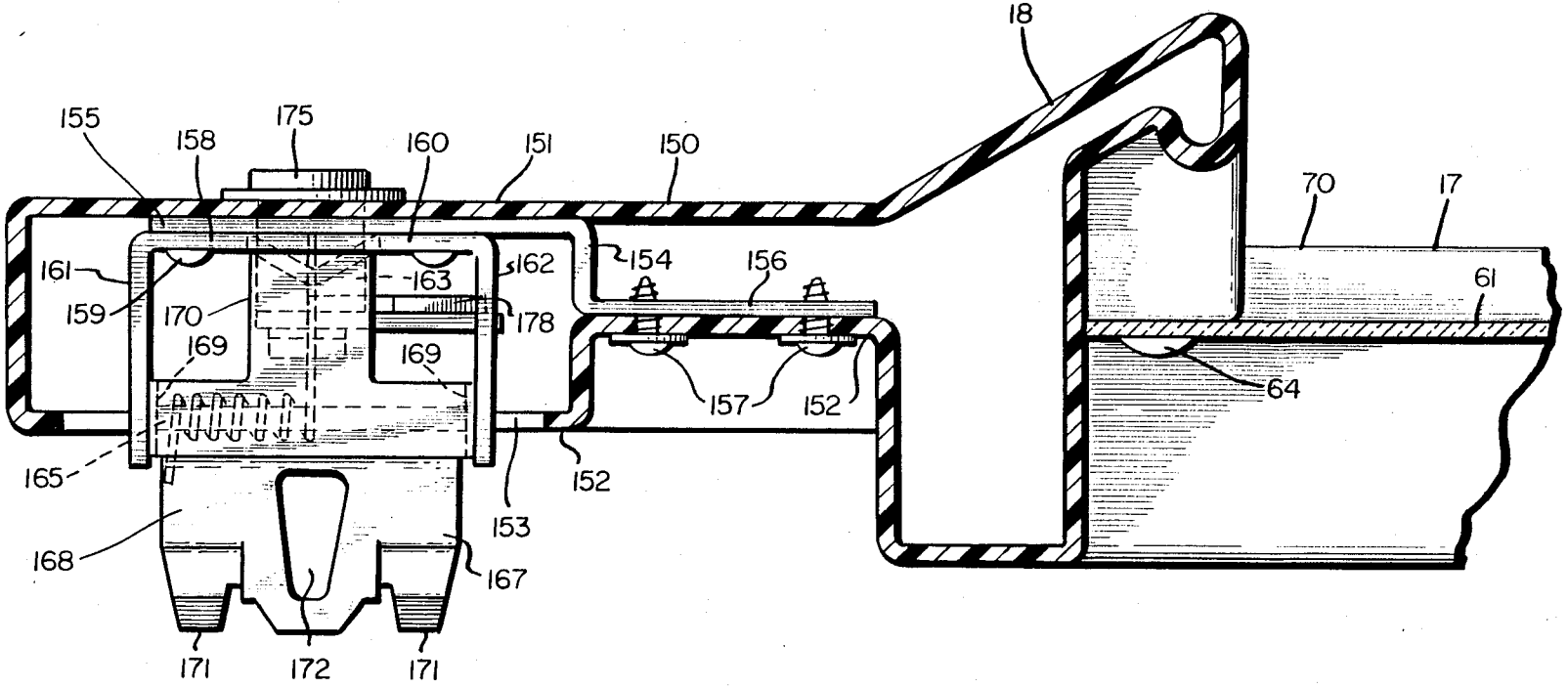
Figure 17:
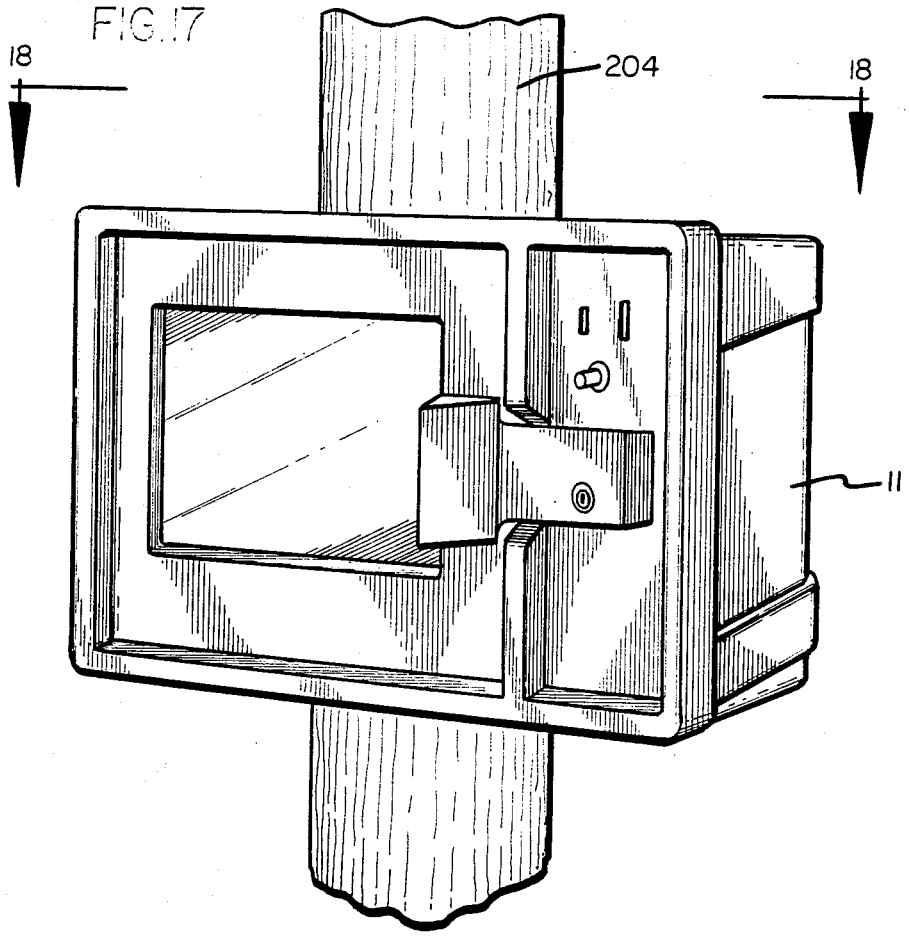
Figure 18:
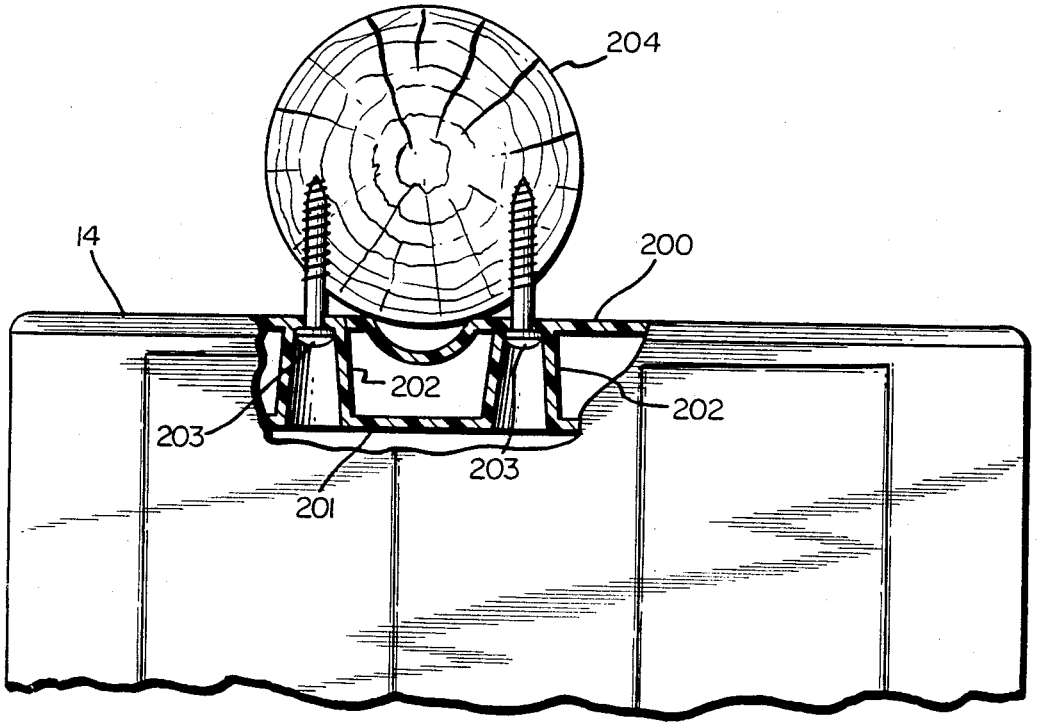

FIG. 5*a* shows a fragmentary view of the pedestal mounting means for mounting the pedestal to the ground;

FIG. 6 shows a cut-away, fragmentary, front view illustrating the access door biasing means and the locking device for retaining the coin operating mechanism in the vending apparatus;

FIG. 7 shows a cut-away, fragmentary, front view of the door lock means for maintaining the access door in an open position and a compartment in the vending apparatus adapted to receive a coin operating mechanism and coin box;

FIG. 8 shows a side, elevation, section view taken along lines 8—8 in FIG. 6 with the coin operating mechanism and cash box being depicted installed in and removed from the vending apparatus;

FIG. 9 shows a perspective view of the cash or coin box adapted to be inserted in the coin operating mechanism shown, for example, in FIG. 8;

FIG. 10 shows a fragmentary, plan, section view of the newspaper vending apparatus of the present invention with the door latch means activated to maintain the door in an open, locked position;

FIG. 11 shows a section view taken along lines 11—11 in FIG. 10 of the retention means for locking the access door in an open position;

FIG. 12 shows a fragmentary, side section view taken along lines 12—12 in FIG. 6 of the mechanism for locking the access door to the coin operating mechanism with the access door in a locked position;

FIG. 13 shows the fragmentary, side section view of FIG. 12 except that the mechanism for locking the door to the coin operating mechanism is in an unlocked position;

FIG. 14 shows the access door locking mechanism located on the back of the access door in a closed, locked position;

FIG. 15 shows the access door locking mechanism of FIG. 14 in an open, unlocked position;

FIG. 16 shows a fragmentary, section view of the access door locking mechanism taken along lines 16—16 in FIG. 14;

FIG. 17 shows a perspective view of the newspaper vending apparatus of the present invention mounted to a pole; and, FIG. 18 shows a fragmentary, top plan view taken along line 18—18 in FIG. 17.

DETAILED DESCRIPTION

Referring to the drawings, a vending machine for newspapers or other articles is indicated generally at 10. The device comprises a paper vending receptacle or box 11 disposed on and connected to a pedestal 12. Receptacle or box 11 comprises top wall 13, bottom wall 14, side walls 15, 16 and back wall 9. A biased access door 17 having a handle 18 is located on the front of box 11 and, when closed, serves to completely enclose papers P in box 11.

A stack of newspapers are deposited on ribbed floor 21 inside box 11. It is appreciated that other articles such as magazines, brochures and the like could be utilized with the vending device of the present invention.

VENDING BOX AND PEDESTAL MOUNTING ASSEMBLY

Figure 2:
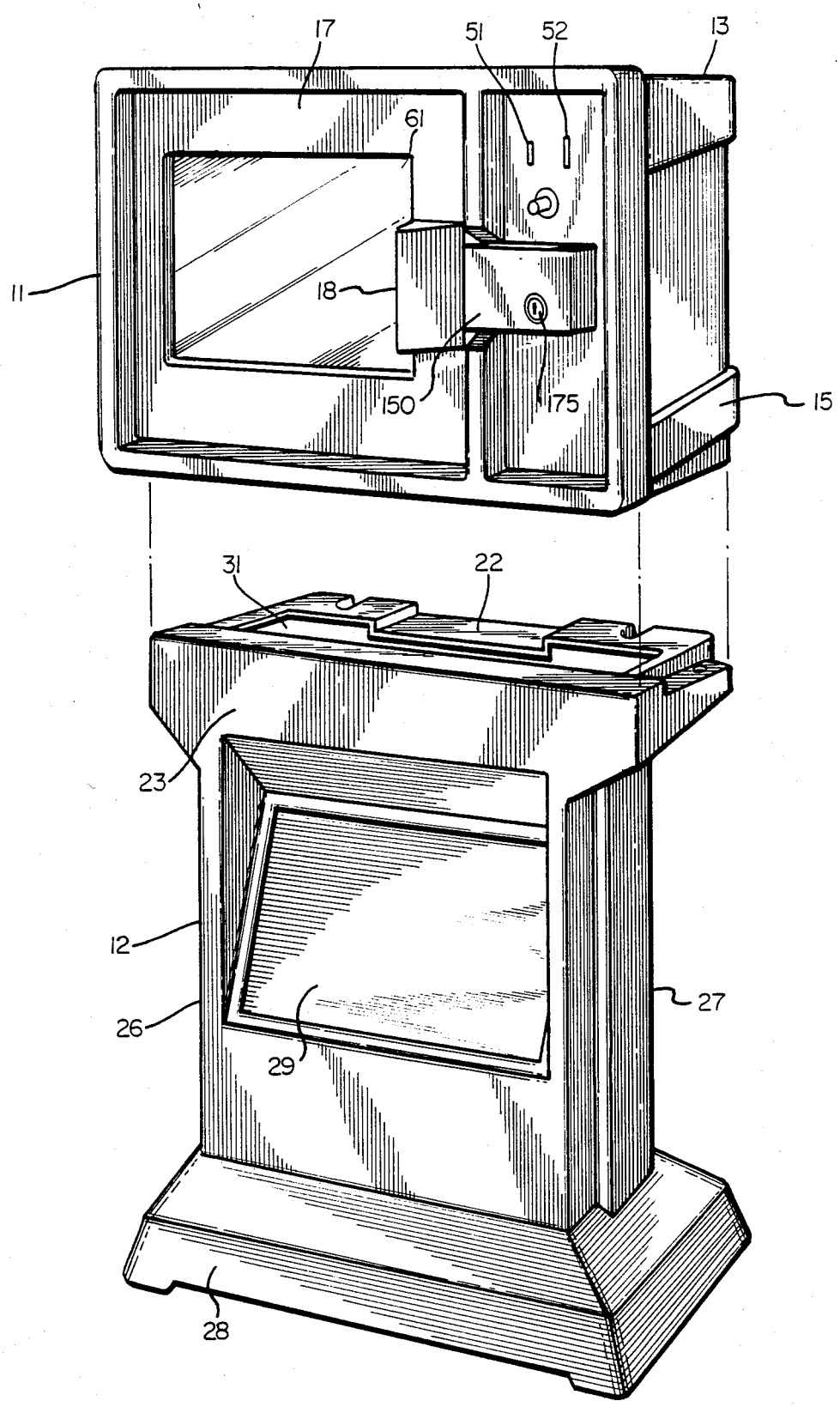
FIG. 2 shows a perspective view of the vending apparatus of FIG. 1 with the vending device separated from the pedestal.
Figure 4:
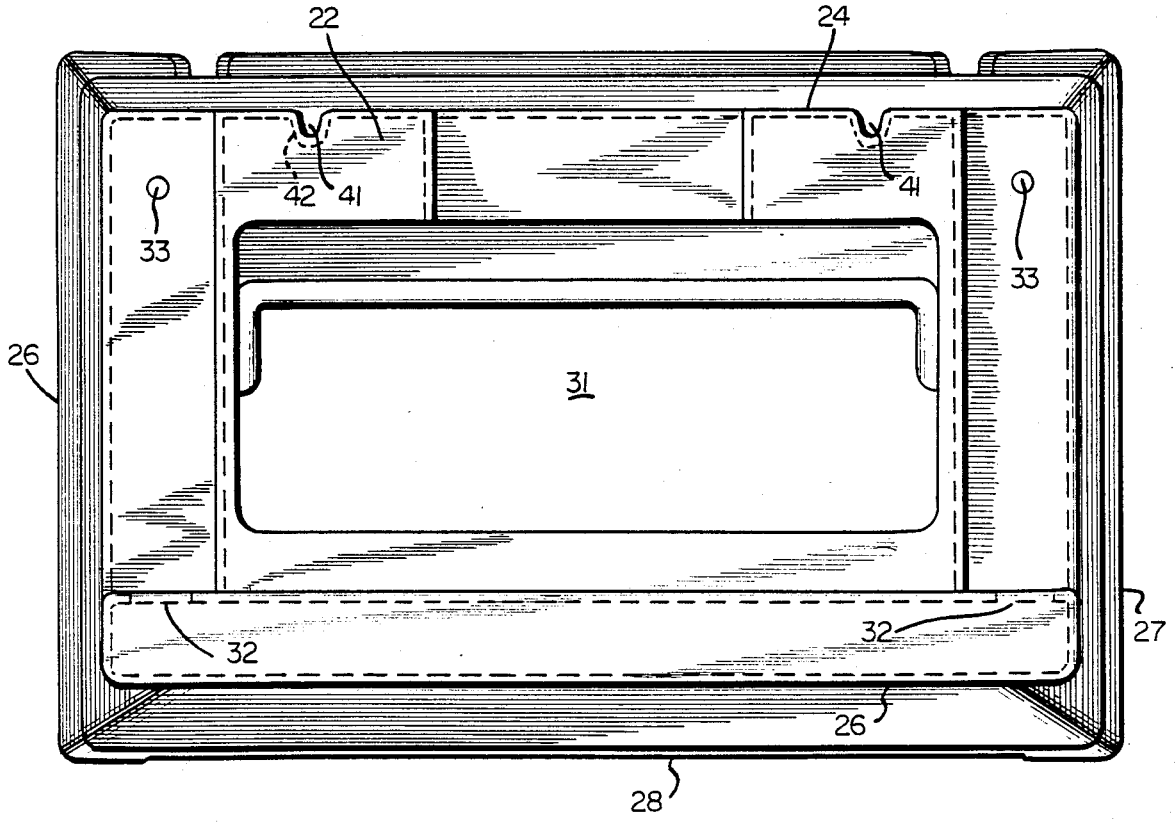
FIG. 4 shows a top, plan view of the pedestal shown in FIG. 2.

As shown in FIGS. 2, 4 and 5, bottom wall 14 is preferably inclined upward from the back wall toward the access door. A pair of lugs 19 are connected to the bottom wall by suitable fastening means such as fasteners 20.

Figure 1:
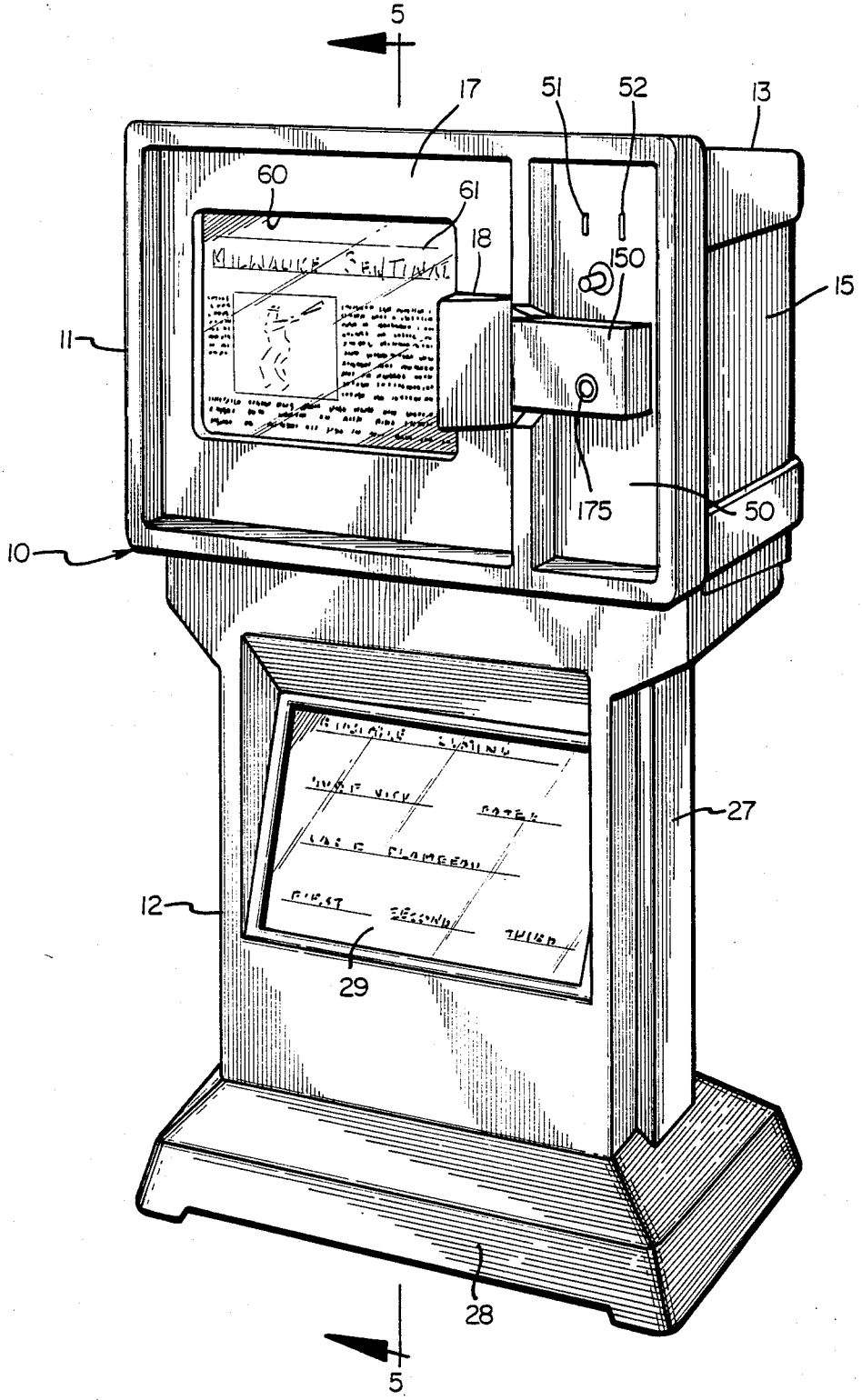

Pedestal 12 comprises a seat 22, front wall 23, back wall 24, side walls 26,27 and pedestal mounting base 28. Front wall 23 has an inclined flat section 29 which is adapted to receive a decal or other suitable indicia or messages (FIG. 1). Base 28 includes a recess 30. Pedestal 12 further includes a hollow portion 31. It also has a seat 22 which has a pair of slots 32 (FIGS. 4, and 8) and recesses or openings 33 adapted to receive bosses 34 located in the bottom of the box 11.

Upon assembly at a job site, pedestal 12 is placed in the desired position. If desired, a Z shaped flanged plate 35 (FIG. 5*a*) having extensions 36, 37 can be utilized to attach the pedestal to the ground or floor.

One extension 36 is inserted in pedestal recess 30 and the other flange extension 37 is fastened in a conventional manner such as by means of bolts 38 to anchor the pedestal to the ground. In assembly, one or more flanged plates 35 are bolted to the ground and pedestal 12 is positioned so that plate extension(s) 36 are disposed in recess 30. Sand or other suitable fill material can be poured into the pedestal opening 31 to assist in anchoring the pedestal to the ground. In some instances, the use of sand or other suitable material will sufficiently anchor pedestal 12 such that the use of flange plate 35 is not necessary.

Following the anchoring of pedestal 12, receptacle 11 is positioned on pedestal seat 22. Box lugs 19 are adapted to slip into pedestal slots 32 (FIG. 8) and vending box bosses 34 are received in pedestal recesses 33.

Figure 3:
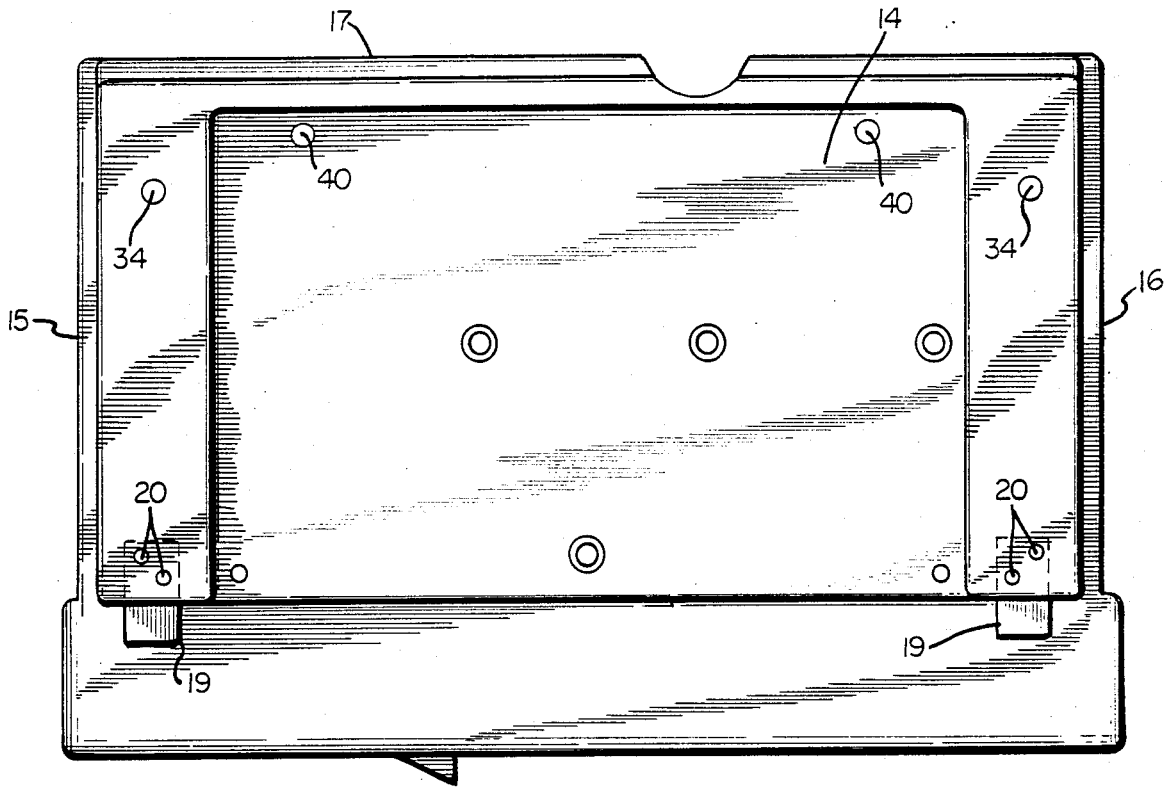
FIG. 3 shows a bottom, plan view of the vending apparatus shown in FIG. 2.

Bottom wall 14 of box 11 is threaded at 40 (FIG. 3) while pedestal seat 22 is recessed at 41. Upon assembly of box 11 to pedestal 12, conventional mounting bolts, or fastners, not shown, having washers thereon are threaded into openings 40 with the fastners disposed to seat in recesses 41. As the bolt is threaded into position, the washers contact the bottom portion 42 of the seat such that vending box 11 is securely fastened to pedestal 12.

The assembled unit provides a newspaper vending machine in which one or more coins can be inserted in openings 51, 52 of a conventional coin operating mechanism 50 whereupon biased door 17 can be opened outwardly (FIG. 10) to permit an individual to remove a paper from box 11.

Box 11 and pedestal 12 can be fabricated from any suitable plastic material. One material that has been utilized is a linear, low density polyethylene material available from Mobil Oil, rotational molding grade No. MRA-115.

PAPER DISPLAY UNIT

Door 17, as seen more clearly in FIG. 5, forms a frame having an has an opening 60. A U-shaped plastic paper display holder 61 comprising a transparent display member or window 62 and a flexible paper retention member 63, which is normally biased toward member 62, is positioned on door 17 to cover opening 60. Holder 61 is fastened to the inner wall of door 17 by plastic fasteners 64 (FIG. 7) or other suitable means. By gently urging flexible member 63 outwardly away from member 62, a paper or other article can be inserted in display member 61. Member 63 then can be released and the display paper will be retained in position and prominently displayed in the window of box 11 as illustrated in FIG. 1.

ACCESS DOOR BIASING MEANS

It will be observed that no hinge or spring members are visible for biasing access door 17 irrespective of whether door 17 is opened or closed. Referring, for example, to FIGS. 5, 6, 10 and 11, door 17 is fabricated to include an outer wall 70 and inner wall 71 spaced from outer wall 70. A first boss 73 is located on the top of outer wall 70 contiguous to the edge 74 of door 17. A second boss 75, FIG. 6, is located on the bottom of outer wall 70 contiguous to the door edge 74 each boss being adapted to be received in a corresponding opening, one of which is located in top inner wall 76 and the other in floor 21 of box 11.

A one-piece torsion spring 80 is inserted in opening 77 of the first boss 73 and passed through the space formed by the inner and outer walls 70, 71 of door 17. Spring 80 has a first section 81 located in the space formed by the inner and outer walls that form the top box wall 13, spring section 81 being limited in its travel at the point where it contacts rib 79 (FIG. 10) which extends between the inner and outer walls forming top box wall 13 or, spring 80 could be formed with suitable bias to be forced past rib 79 so as to react against inside top front surface of box 11.

Spring 80 further includes a flexible, second section 82 which extends downward and perpendicular to spring section 81, section 82 passing through opening 77 in boss 73 (FIG. 11) into the space formed by inner and outer access door walls 70, 71. Upon installation, the outboard end of spring section 82 is initially directed or snaked to pass inside wall lugs 83 and 84 and then upward, as seen in FIG. 6, until the end of spring section 82 abuts wall lug 85 whereby spring section 82 forms somewhat of a U-shaped member. It will be observed that spring 80 is hidden from view at all times and at no time is it directly exposed to the elements.

When access door 17 is opened by pulling handle 18 outward, the door will open sideways with bosses 73 and 75 rotating in corresponding openings, only one of which 77 is shown, in box 11. As door 17 opens outward, spring 80 is torsionally wound and when one allows door 17 to return to its closed position, the spring period for spring 80 will dictate the speed with which the door will return to a closed position. It has been found that spring 80 can be made of a stainless steel material furnished by Racine Iron & Wire, Racine, Wisconsin, the steel being designated as ASTM 313, Type 302, Class 1 with a tensile strength of 205,000–235,000 psi. It is appreciated that a person of ordinary skill in the art could design a spring having varying spring characteristics suitable for a particular application.

ACCESS DOOR LATCH MEANS

There are occasions when it is desired to maintain access door 17 in an open position. For example, when loading papers P into box 11, a vendor desires that door 17 be in an open position while accomplishing the paper loading operation. A locking latch means 90 shown in FIG. 10 and 11 serves to accomplish this objective. Latch means 90 comprises slidable bar 91 comprising a first bar section 92. A second bar section 93, which serves as a handle, extends downwardly from one end of the first bar section at a right angle to section 92. Handle section 93 extends into slot 94 in inner wall 71 of door 17 while section 92 is disposed in the space formed by inner and outer door walls 70, 71. The remaining end of bar section 92 extends through opening 95 (FIG. 11) in outer door side wall 74. A locking bolt or other suitable fastner 96 is attached to bar section 93 such that bar 90 is adapted to move along the longitudinal axis of bar section 92 for a distance equal to the length of the slot 94.

When it is desired to maintain the door in an open position such as shown in FIG. 10, access door 17 is held open at substantially a right angle to box 11 and handle section 93 is moved from position "A" to "B" as seen more clearly in FIGS. 10, 11. As bar section 93 moves toward position B, bar section 92 moves through opening 95 and extends into box 11 adjacent inner wall 16' of box side wall 16. When door 17 is released, it will attempt to return to its normally closed position; however, end 97 of bar section 92 abuts wall 16' and causes bar 91 to be wedged into a locking position such that door 17 is precluded from closing. To release locking latch 90, door 17 is merely held at 90° to box 11 and bar section 93 is returned to position "A" whereupon bar section 92 is withdrawn from box 11 and is positioned inside access door 17 such that bar end 97 extends only slightly beyond opening 95. When latching means 90 is in this withdrawn position, access door 17 can return to a normally closed position.

COIN OPERATING MECHANISM LOCKING MEANS

Referring to FIGS. 6–8 it will be observed that coin operating mechanism 50 is disposed in compartment 110 in vending box 11. Coin operation mechanism 50 is a conventional coin operating unit presently available in the market. Mechanism 50 includes conventional coin deposit slots 51, 52, coin return button 53 and coin return opening 54. A conventional coin box 100 (FIG. 9) is adapted to be inserted at the bottom of the coin return mechanism as seen in FIG. 8. Coin box 100 has a lock 101 adapted to maintain lid 102 in a locked position. Coin box 100 is disposed in a coin box compartment located at the bottom of mechanism 50 (FIG. 8) and retained in position by U-shaped bar 103. Bar 103 is pivotally connected to mechanism 50. Arms 104, only one of which is shown, is pivotally fastened to mechanism side walls 123, 124. When bar 104 is pivoted to the position shown in FIG. 8, coin box 100 is locked in position.

Mechanism 50 is adapted to fit into compartment 110 located in box 11 adjacent door 17. As seen in FIGS. 7 and 8, compartment 110 is formed by spaced vertical side walls 111, 112, top wall 113, bottom wall 114 and back wall 115 which, as shown in FIG. 8, is spaced from back wall 14.

Coin mechanism 50 includes a bar 120 (FIGS. 6, 8) located at the rear of the top section of mechanism 50, bar 120 being fixed at its ends 121, 122 to the spaced side walls 123, 124.

A rotatable locking pawl 130 is disposed within compartment 110 and comprises a locking bar section 131 which terminates at each end into depending arms 132, 133 disposed at 90° to bar section 131. Arms 132, 133 are each connected to a rotation member 134, 135. Member 134 extends into an opening 136 in box wall 111 and, as shown in FIGS. 7, 8, the end of rotation member 134 is connected to a conventional lock device 139. Rotating member 135 is disposed in opening 137. To actuate pawl 130, a key is inserted in lock 139 and rotated. Upon rotation, pawl 130 is rotated from the unlocked position "C" to the locked position "D" shown in FIG. 8. Upon rotation of locking pawl 130, arms 132, 133 contact bar 120 (FIG. 6) and preclude bar 120 and coin mechanism 50 from removal from compartment 110.

Coin mechanism 50 further includes a pair of lugs 140, 141 which are adapted to be received in openings 142, only one of which is shown, in bottom box wall 114. In operation, mechanism 50 is placed in box 11 by initially inserting lugs 140, 141 into openings 142. The mechanism then is fitted within compartment 110 whereupon key lock 139 is actuated causing pawl 130 to rotate to the locking position "D" shown in FIG. 8 so that mechanism 50 is locked in position in box 11. Removal of mechanism 50 from compartment 110 is achieved merely by reversing the abovedescribed steps whereupon the key is rotated in lock member 139 until pawl 130 is in position "C" shown in FIG. 8 and coin operating mechanism 50 can be readily removed from compartment 110.

MEANS FOR LOCKING ACCESS DOOR TO COIN OPERATING MECHANISM

Referring to FIGS. 14–16, access door 17 includes a lock unit 150 which extends outward from door 17 adjacent handle 18.

Door lock unit 150, as seen in FIG. 16, comprises outer wall 151 and inner wall 152 spaced from the outer wall. Opening 153 is located in inner wall 152. Flange plate 154 comprising plate section 155 and flange section 156 is disposed in the space between walls 151, 152. Flange plate 154 is fastened by screws 157 or other suitable means to one side of inner wall 152.

Bracket 158 is connected by fasteners 159 to flange plate 154. Bracket 158 comprises a base 160, a pair of arms 161, 162 extending outward from the side of the base and a cam follower stop 163 which projects outward from bracket base 160.

Rod 165 is fixedly connected at its ends to bracket arms 161, 162. Spring 166 is disposed on rod 165 and is connected to pivotable lock plate 167 mounted on rod 165. Lock plate 167 includes base 168 having a pair of mounting arms 169, 169 extending from the base, the mounting arms being positioned on rod 165. A cam follower 170 extends outward from one side of lock plate 167. Extending from base 168 are two locking fingers 171 adapted to engage a locking mechanism in coin operating mechanism 50. Base 168 also includes an opening 172 disposed between spaced locking fingers 171.

Door lock unit 150 also includes a conventional key actuated locking device 175. Attached to the end of the lock device 175 opposite the end where a key is normally inserted, is arm 176 (FIG. 14, 15) which is bolted at 177 to lock device 175. Cam 178 is riveted at 179 to arm 176, cam 178 being adapted to engage cam follower 170 whereby the cam follower is forced upward to place lock plate 167 in an access door unlocking position.

It will be observed from viewing FIGS. 12–16 that when a key is inserted in access door lock 175 and turned, arm 176 moves from position "E" to "F" (FIG. 14) whereby cam 178 urges biased cam follower 170 upward. In this position, lock plate base 168 pivots downwardly and tang 182, disposed in coin operating mechanism 50, disengages from opening 172 (FIG. 12, 13) whereby door lock unit 150 disengages or unlocks from coin operating mechanism 50 and access door 17 is open. To relock or re-engage the door lock unit, one need only rotate key lock 175 to its normal position whereupon cam 178 is disengaged from cam follower 170 and biased lock plate 167 pivots until cam follower 170 abuts cam follower stop 163 and tang 182 reengages lock plate 167 in opening 172.

A pair of spaced brackets 190, 191 are mounted to flange plate 154, a plastic roller 193 is mounted on pin 194 which, in turn, is rotatably mounted on mounting brackets 190, 191.

Closure box 195 extends outward from coin operating mechanism 50, the box comprising top wall 196, bottom wall 197 and side walls 198, only one of which is shown in FIGS. 12 and 13. Roller member 193 is adapted to engaged bottom wall 197 of the closure box 195 to aid in the closing of door lock unit 150.

POLE MOUNTED NEWSPAPER VENDING BOX

While the present invention has been described with box 11 being disposed on pedestal 12, it is appreciated that box 11 can be mounted in a manner which permits one to dispense with pedestal 12. Referring to FIGS. 17 and 18, box 11 having the features heretofore described, is shown removed from pedestal 12. Bolts can be inserted through four bolt holes which are located in box back wall 14. The back wall includes outer wall 200, inner wall 201 spaced from the outer wall and bolt ribs 202. Bolts and washer arrangements 203 pass through the back wall 200 and attach the box to the pole 204 as shown in FIGS. 17 and 18. It is appreciated that instead of screwing box 11 directly to pole 204, suitable band members could be utilized to attach the top and bottom of the box to pole 204.

While one or more embodiments of the invention have been herein illustrated and described in detail, it will be understood that modifications and variations thereof may be effected without departing from the spirit of the invention and the scope of the appended claims.

We claim:

1. A vending apparatus for newspapers or other articles comprising:

a receptacle adapted to receive said newspaper comprising a top, bottom and spaced side walls;

an access door connected to said receptacle for gaining access to said member;

access door closure means including biasing means for closing and biasing said door to be in a normally closed position;

said closure means including said biasing means being substantially enclosed within said receptacle and access door whereby said closure means including said biasing means is hidden from view and free from direct exposure to the weather elements when said access door is open and when said access door is closed.

2. A vending apparatus in accordance with claim 1 wherein said door and receptacle are fabricated from plastic.

3. A vending apparatus in accordance with claim 2 wherein said receptacle top wall includes two separate, spaced walls and said access door includes spaced inner and outer walls; and, said closure means including said biasing means is substantially entirely disposed within said spaced walls in said top wall and said door.

4. A vending apparatus in accordance with claim 1, 2 or 3 wherein said biasing means comprises a torsion spring means substantially completely enclosed within said door and receptacle.

5. A vending apparatus in accordance with claim 4 wherein a portion of said torsion spring is disposed within the spaced walls of said top wall and another portion of said spring is disposed within said spaced walls of said access door.

6. A vending apparatus in accordance with claim 1 wherein said access door closure means includes means for pivotally connecting said door to a side of said receptacle whereby said door opens along a side of the receptacle and said closure means is free from direct exposure to the weather elements.

7. A vending apparatus in accordance with claim 6 wherein said access door and said receptacle each include closure means for pivoting said door about an axis located along and contiguous to the outboard end of one of said side walls to permit said access door to be opened to expose the inside of said receptacle.

8. A vending apparatus in accordance with claim 1 wherein said access door has a top, bottom and spaced side walls a first boss disposed on said door top;

a second boss disposed on said door bottom, said bosses being located contiguous to one of said access door side walls;

said receptacle including a first boss receiving opening in said receptacle top, a second boss receiving opening in said receptacle bottom;

said first and second bosses being disposed within said first and second openings respectively whereby said bosses and openings are substantially free from direct exposure to the weather elements.

9. A vending apparatus in accordance with claim 1 and further including an access door stop means for maintaining said access door in an opened, biased position.

10. A vending apparatus in accordance with claim 9 wherein said door stop means includes a movable latch means disposed in said door, said latch means comprising a bar which is movable from an inoperable to an operable, door stop position.

11. A vending apparatus in accordance with claim 10 in which said latch means is substantially enclosed within said door when in an inoperable position.

12. A vending apparatus in accordance with claim 11 wherein said access door includes a slot located in one door wall and an opening in a second door wall;

said latch means comprising a bar member and a handle depending from one end of said bar member; said handle passing through said slot and said bar member passing through said second door wall opening whereupon movement of said handle along the length of said slot causes said bar member to move through said opening into said receptacle where said bar member is disposed adjacent a receptacle wall and abuts said wall to preclude said access door from closing.

13. A vending apparatus in accordance with claim 1 and further including a pedestal, said pedestal having a base and a seat spaced from said base; and, said receptacle being disposed on said pedestal seat.

14. A vending apparatus in accordance with claim 13 and further including means for removably connecting said receptacle to said pedestal.

15. A vending apparatus in accordance with claim 14 wherein said receptacle has a pair of lugs disposed on the bottom of said receptacle, said pedestal having a pair of slots adapted to receive said lugs; and, fastening means for removably connecting and locking said receptacle to said pedestal; said fastening means being located within said receptacle and pedestal so as not to be visible from the outside of said vending apparatus.

16. A vending apparatus in accordance with claim 1 wherein said access door comprises a fabricated plastic frame having an opening therein;

a transparent display member connected to said door and covering said opening;

said display member including means for holding an paper or other article to be displayed.

17. A vending apparatus in accordance with claim 16 wherein said display means comprises a one piece unitary member including a display face and a resilient leg adapted to maintain an article to be displayed adjacent said display face.

18. A vending apparatus in accordance with claim 17 in which said display means comprises a plastic U-shaped member fastened to said door frame and covering said opening.

19. A vending apparatus in accordance with claim 18 wherein said display means is riveted to said door frame.

20. A vending apparatus in accordance with claim 1 wherein said receptacle further includes a compartment for receiving a coin operating mechanism; and, means for locking said coin operating mechanism in said apparatus.

21. A vending apparatus in accordance with claim 20 wherein said coin operating mechanism includes a bar means, and said locking means comprises a locking pawl disposed within said compartment;

said locking pawl being adapted for movement from a locked to an unlocked position whereby when said locking means is in a locked position, said locking pawl contacts said bar means.

22. A vending apparatus in accordance with claim 21 wherein said receptacle comprises a first compartment for receiving papers or other articles to be vended and a second compartment separated from the first compartment, said second compartment being adapted to receive a removable coin operating mechanism.

23. A vending apparatus in accordance with claim 22 wherein said coin operating mechanism further includes at least one lug located contiguous to the bottom of said coin operating mechanism;

said second compartment having at least one slot located in a wall of said second compartment adapted to receive said lug when said coin operating mechanism is disposed within said second compartment; and, said slot and lug being free from direct exposure to the weather elements.

24. A vending apparatus in accordance with claim 23 and further including a key lock means disposed in said receptacle and connected to said pawl;

said key lock means having a key means disposed in said first paper receiving compartment whereby upon activation of said key lock means, said pawl is movable from a locked to an unlocked position.

25. A vending apparatus in accordance with claim 20 and further including a locking means for locking said access door to said coin operating mechanism.

26. A vending apparatus in accordance with claim 25 where said access door locking means is connected to said access door and includes a pivotable locking plate, a locking means disposed on said coin operating mechanism and connected to said door locking plate, and, means disengaging said locking plate from said mechanism locking means.

27. A vending apparatus in accordance with claim 26 wherein said locking plate includes an opening disposed therein and said coin operating mechanism locking means include a tang which normally engages said locking plate.

28. A vending apparatus for newspapers or other articles comprising, a receptacle having a top, bottom and spaced side walls;

said receptacle including a first compartment for receiving newspaper or other articles;

a second compartment for receiving a coin operating mechanism;

an access door connected to said receptacle along the side of said access door whereupon said door will open along a side wall of said receptacle;

closure means including biasing means connected to said door and receptacle for biasing said door in a normally closed position; and, said closure means being disposed substantially completely within said receptacle and said door free from direct exposure to the weather elements when said access door is open and when said access door is closed.

29. A vending apparatus in accordance with claim 28 wherein said door and receptacle are fabricated from plastic.

30. A vending apparatus in accordance with claim 29 wherein said plastic is polyethylene.

31. A vending apparatus in accordance with claim 28 wherein said access door has an opening therein;

a display member connected to said door and covering said opening;

said display member further including a unitary flexible member adapted to be biased toward said display member.

32. A vending apparatus in accordance with claim 31 wherein said display member comprises an unitary, U-shaped plastic member having a transparent section positioned to overlie said door opening and further including a compartment adapted to maintain a paper in a position of display.

33. A vending apparatus in accordance with claim 30 wherein said biasing means comprises a torsion spring disposed substantially, completely within said access door and receptacle.

34. A vending apparatus in accordance with claim 30 and further including a pedestal upon which said receptacle is seated.

35. A vending apparatus in accordance with claim 30 and further including a locking means for locking said coin operating mechanism in said second compartment.

36. A vending apparatus in accordance with claim 30 and further including a locking unit connected to said access door, said locking unit including a cam means for disengaging said locking unit from a locking means in said coin operating mechanism.

* * * * *

UNITED STATES PATENT AND TRADEMARK OFFICE

CERTIFICATE OF CORRECTION

PATENT NO. : 4,919,250

DATED : April 24, 1990

INVENTOR(S) : Olson, et al.

It is certified that error appears in the above-identified patent and that said Letters Patent is hereby corrected as shown below:

Column 2, line 56, delete the "p" between the words "DRAWINGS" and "FIG." and insert a new paragraph;

Column 4, line 62, delete the words "an has"; and,

Column 7, line 19, insert a hyphen between the words "above" and "described".

Signed and Sealed this

Sixteenth Day of July, 1991

*Attest:*

*Attesting Officer*

HARRY F. MANBECK, JR.

*Commissioner of Patents and Trademarks*